US010968409B2

(12) United States Patent
Conrad et al.

(10) Patent No.: US 10,968,409 B2
(45) Date of Patent: Apr. 6, 2021

(54) FUEL ADDITIVE FOR CLEANING AN INTERNAL COMBUSTION ENGINE

(71) Applicant: TUNAP GmbH & Co. KG, Wolfratshausen (DE)

(72) Inventors: Iris Conrad, Wolfratshausen (DE); Christoph Hochstein, Geretsried (DE); Alfons Urban, Bad Heilbrunn (DE)

(73) Assignee: TUNAP GmbH & Co. KG, Wolfratshausen (DE)

( * ) Notice: Subject to any disclaimer, the term of this patent is extended or adjusted under 35 U.S.C. 154(b) by 0 days.

(21) Appl. No.: 16/328,652

(22) PCT Filed: Aug. 24, 2017

(86) PCT No.: PCT/EP2017/071324

§ 371 (c)(1),
(2) Date: Feb. 26, 2019

(87) PCT Pub. No.: WO2018/041710

PCT Pub. Date: Mar. 8, 2018

(65) Prior Publication Data

US 2020/0165533 A1 May 28, 2020

(30) Foreign Application Priority Data

Sep. 1, 2016 (DE) ..... 10 2016 116 348.1

(51) Int. Cl.
*C10L 1/223* (2006.01)
*C10L 1/2387* (2006.01)
(Continued)

(52) U.S. Cl.
CPC ..... *C10L 1/223* (2013.01); *C10L 1/2387* (2013.01); *C10L 10/06* (2013.01); *C10L 10/10* (2013.01);
(Continued)

(58) Field of Classification Search
CPC ..... C10L 1/223; C10L 1/2387; C10L 10/06; C10L 10/10; C10L 2200/0423; C10L 2270/023; F02B 77/04
See application file for complete search history.

(56) References Cited

U.S. PATENT DOCUMENTS 2,107,147 A 2/1938 Elley et al.
4,588,417 A 5/1986 Zaweski et al.
(Continued)

FOREIGN PATENT DOCUMENTS

CN 1167136 A 12/1997
CN 100355867 C 12/2007
(Continued)

OTHER PUBLICATIONS

Federal Institute for Industrial Property, Search Report, dated Aug. 26, 2019, pp. 1-8, Moscow, Russian Federation.
(Continued)

*Primary Examiner* — Cephia D Toomer
(74) *Attorney, Agent, or Firm* — Robert A. Blaha; Smith Tempel Blaha LLC

(57) ABSTRACT

The present invention relates to the use of at least one, optionally alkylated diarylamine in a fuel or a fuel additive for cleaning the combustion chamber of an internal combustion engine, in particular of a motor vehicle engine. A further aspect relates to a method for cleaning the combustion chamber of an internal combustion engine during the operation of the internal combustion engine by burning a fuel, wherein the fuel contains a fuel additive comprising at least one, optionally alkylated diarylamine.

12 Claims, 4 Drawing Sheets

(51) Int. Cl.

| | |
|---|---|
| ***C10L 10/06*** | (2006.01) |
| ***C10L 10/10*** | (2006.01) |
| ***F02B 77/04*** | (2006.01) |
| ***F02M 65/00*** | (2006.01) |

(52) U.S. Cl.
CPC ..... *F02B 77/04* (2013.01); *F02M 65/007* (2013.01); *C10L 2200/0423* (2013.01); *C10L 2270/023* (2013.01)

(56) References Cited

U.S. PATENT DOCUMENTS

| | | | | |
|---|---|---|---|---|
| 5,536,280 | A | 7/1996 | DeRosa et al. | |
| 2005/0115146 | A1* | 6/2005 | Jackson | C10L 1/1832 44/450 |
| 2005/0172546 | A1* | 8/2005 | Spivey | C10L 1/14 44/412 |
| 2008/0086936 | A1 | 4/2008 | Cunningham et al. | |
| 2014/0187458 | A1* | 7/2014 | Galic Raguz | C10M 167/00 508/500 |

FOREIGN PATENT DOCUMENTS

| | | | |
|---|---|---|---|
| CN | 101812335 | * | 8/2010 |
| CN | 101812335 | A | 8/2010 |
| CN | 102719287 | A | 10/2012 |
| DE | 37 32 908 | A1 | 4/1989 |
| EP | 1 918 355 | A1 | 5/2008 |
| JP | 2000-212582 | A | 8/2000 |
| JP | 2000212582 | * | 8/2000 |
| RU | 2 174 998 | C2 | 10/2001 |
| RU | 2 576 327 | C1 | 2/2016 |
| WO | WO2015042337 | A1 | 3/2015 |

OTHER PUBLICATIONS

Vetrova, E.A.; Federal Institute for Industrial Property, Office Action, dated Aug. 26, 2019, pp. 1-5, Moscow, Russian Federation.

Kalghatgi G., "The Outlook for Fuels for Internal Combustion Engines," International Journal of Engine Research, 2014, vol. 15(4) pp. 383-398.

Kalghatgi G., "The Outlook for Fuels for Internal Combusion Engines," International Journal of Engine Research, 2041, vol. 15(4) pp. 383-398.

Lauer T. et al., "Modellansatz zur Entstehung von Vorentflammungen," MTZ, Jan. 2014, pp. 64-70.

Yasueda S. et al., Abnormal Combustion caused by Lubricating Oil in High BMEP Gas Engines, MTZ Industrial 3, (2013), pp. 34-39.

Dahnz C. et al., "Irregular Combustion in Supercharged Spark Ignition Engines—Pre-ignition and Other Phenomena," International Journal of Engine Research 11 (2010), pp. 485-498.

Zahdeh A. et al., "Fundamental Approach to Investigate Pre-ignition in Boosted SI Engines," SAE Technical Paper 2011-01-340.

Stepien Z., "Intake Valve and Combustion Chamber Deposit Formation—the Engine and Fuel Related Factors that Impacts Their Growth," NAFTZ-GAX, ROK LXX, No. 4/2014.

Cheng S.S., "The IMpact of Engine Operating Conditions and Fuel Compositions on the Formation of Combustion Chamber Deposits," SAE Paper 2000-01-2025.

Kalghatgi G.T., "Fuel and Additive Effects on the Rates of Growth of Combustion Chamber Deposits in a Spark Ignition Engine," SAE Paper 972841.

Technical Committee of Petroleum Additive Manufacturers in Europe, "Fuel Additives: Use and Benefits," (Sep. 1, 2013), URL: https://www.atc-europe.org/public/Doc113 2013-10-01.pdf, (Mar. 8, 2016), XP055256377 [A] 1-13 * p. 27.

Database WPI, 0, Derwent World Patents Index, vol. 2010, No. 76, Database accession No. 2010-L65232, XP002774951 & CN101812335 A, Aug. 25, 2010, Xinghuo Sci & Technology Inst Manzhouli) [A] 1-13 * Abstract.

Mori, Kenichi, Notice of Reasons for Refusal of Japanese Patent Application No. 2019-510346, dated Dec. 26, 2019, Japan Patent Office, pp. 1-2.

Hearing Notice in Reference of Application No. 201917006356; pp. 1-2; Oct. 21, 2020; Government of India Patent Office; Intellectual Property Building, G.S.T. Road, Guindy, Chennai-600032, India.

Office Action in Application No. 201780053015.6, China National Intellectual Property Administration, dated Jun. 24. 2020, pp. 1-7, 6 Xituchenglu, Jimen Bridge, Haidian District, P.O. Box 8020, Beijing 100088, China.

* cited by examiner

FUEL ADDITIVE FOR CLEANING AN INTERNAL COMBUSTION ENGINE

TECHNICAL FIELD

The present invention relates to the use of at least one, optionally alkylated diarylamine in a fuel or a fuel additive for cleaning the combustion chamber of an internal combustion engine, in particular of a motor vehicle engine. A further aspect relates to a method for cleaning the combustion chamber of an internal combustion engine during the operation of the engine by burning a fuel, wherein the fuel contains a fuel additive comprising at least one, optionally alkylated diarylamine.

TECHNOLOGICAL BACKGROUND

The worldwide tightening of exhaust gas legislation and the demand for lower fuel consumption lead, in the development of internal combustion engines such as motor vehicle engines, to reduced engine size ("downsizing"), direct injection and high boost pressures. Internationally varying legislation, the technically very sophisticated engine technology and the increasingly ambitious exhaust gas standards mean that the currently available fuels no longer satisfy the requirements of motor vehicle engines. In particular, chemical processes in the fuel system can lead to dirt, deposits, coking and coatings. Further factors affecting the increased formation of deposits and contamination in the engine are, for example, varying fuel qualities, the addition of bio-components and an increased metal content in the fuel. This can result in increased $CO_2$ emissions, increased consumption, a higher susceptibility to faults in the engine and costly repairs.

A further problem of current development is the increased risk of pre-ignition occurring during operation of the engine. Pre-ignition is a self-ignition phenomenon which occurs more at high load or high medium pressures and low engine speed operation conditions ("Low Speed Pre-Ignition, LSPI"). In the process, combustion starts before the actual ignition point.

A distinction should be drawn between pre-ignition and the previously known phenomenon of knocking. In contrast to knocking, pre-ignition occurs independently of the combustion initiated by the spark plug. Traditional knocking in direct-injection engines therefore takes place after the ignition point, but in the case of pre-ignition, the increase in pressure as a result of heat release starts before the ignition point. Generally, pre-ignition leads to extreme pressure peaks and, as a result of the high burning rates, extreme pressure gradients and high-frequency pressure oscillations. The occurrence of pre-ignition can therefore rapidly lead to engine damage. Sequences with an alternating combustion sequence have a particularly damaging effect. The damage potential of pre-ignition is much higher than that of other self-ignition phenomena such as knocking, since even individual events can lead to destruction of the engine, owing to extremely high pressure peaks. This greatly restricts the performance of modern engines.

It has been demonstrated that there is no relationship between the octane number or ignition ability and the tendency to pre-ignite, which confirms that traditional knocking and pre-ignition are two different self-ignition phenomena (Kalghatgi G. "*The outlook for fuels for internal combustion engines*" International J of Engine Research 2014, vol. 15(4) pages 383-398).

The factors influencing pre-ignition are very complex, and the initiation mechanisms form the subject matter of current research. In particular, detached oil-fuel droplets or glowing particles of deposits are discussed as possible causes of pre-ignition (Lauer T. et al "*Modellansatz zur Entstehung von Vorentflammungen*" MTZ 01/2014 pages 64-70; Yasueda, S. et al "*Abnormal Combustion caused by Lubricating Oil in High BMEP Gas Engines*", MTZ Industrial 3 (2013), pages 34-39; Dahnz, C. et al "*Irregular combustion in supercharged spark ignition engines—pre-ignition and other phenomena*", International Journal of Engine Research 11 (2010), pages 485-498; Zandeh, A. et al. "*Fundamental Approach to Investigate Pre-Ignition in Boosted SI Engines*" SAE Technical Paper 2011-01-0340).

Glowing particles or glowing detached deposits have been identified both as initial pre-ignition initiators and subsequent pre-ignition initiators. Deposits are detached in particular by severe knocking, and therefore a large number of detached deposits or particles fly around freely in the combustion chamber at the end of a pre-ignition event, which in turn can lead to further pre-ignition event in the following combustion cycles.

For this reason, combustion chamber deposits are of particular interest. Deciding factors for the formation of deposits at inlet ducts and in the combustion chamber are fuel composition, engine oil, the engine design and the operating conditions of the engine.

Fuel additives likewise have an important influence on deposit formation. It has been shown that traditional detergents based on polybutyleneamine and polyetheramine reduce deposits at inlet ducts but can at the same time increase deposits in the combustion chamber (Stepien Z. "*Intake valve and combustion chamber deposit formation—the engine and fuel related factors that impacts their growth*", NAFTA-GAZ, ROK LXX, No. 4/2014; Cheng S. S. "*The Impact of Engine Operating Conditions and Fuel Compositions on the Formation of Combustion Chamber Deposits*" SAE Paper 2000-01-2025; Kalghatgi G. T. "*Fuel and Additive Effects on the Rates of Growth of Combustion Chamber Deposits in a Spark Ignition Engine*" SAE Paper 972841).

U.S. Pat. No. 5,536,280 relates to fuel compositions containing diphenylamine. It is disclosed in particular that the addition of diphenylamines leads to a reduction in knocking of an internal combustion engine owing to the increase in the octane number of the fuel.

WO 2015/042337 relates to a method for reducing the possibility of pre-ignition in a direct-injection internal combustion engine, in which a lubricant composition containing a base oil and an ash-free antioxidant is supplied to the engine.

SUMMARY

There may be a need to reduce deposit formation in internal combustion engines, in particular in motor vehicles, and to clean the engine of existing deposits. In particular, there is a need for fuel additives which clean the engine of deposits during its operation and reduce further formation of deposits. Surprisingly, the use of at least one, optionally alkylated diarylamine in a fuel or fuel additive cleans the combustion chamber of an internal combustion engine.

Embodiments of the invention reduce deposit formation in internal combustion engines and clean the engine of deposits, in particular during operation. A method for cleaning the combustion chamber of an internal combustion engine during the operation thereof by burning a fuel, wherein the fuel contains an additive comprising at least one, optionally alkylated diarylamine.

DETAILED DESCRIPTION OF ILLUSTRATED EMBODIMENTS

Figure 1:
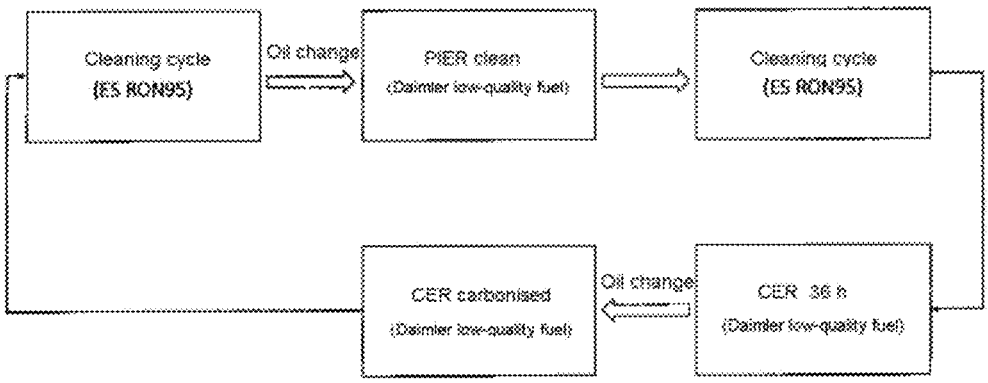
FIG. 1: Exemplary engine test run to determine the cleaning performance of a fuel additive according to the present invention.

It could surprisingly be shown by the present invention that, thanks to the use of at least one diarylamine, which can optionally be alkylated, in a fuel or fuel additive, the combustion chamber of an internal combustion engine can be cleaned by combustion of the additive-containing fuel without adversely affecting engine performance. The use according to the invention also reduces or prevents deposits forming again. The term "cleaning" as used in the present invention thus includes both the removal of existing deposits and dirt (what is known as the clean-up effect) such as carbonisation and coatings, and the prevention or avoidance of the occurrence of new deposits and dirt (what is known as the keep clean effect).

The cleaning of the combustion chamber according to the invention includes in particular the cleaning of the piston surface and/or the cleaning of the injector nozzle of the internal combustion engine. Cleaning thus takes place during combustion of the fuel which contains at least one fuel additive containing diarylamine.

The use according to the invention of the at least one diarylamine in a fuel or fuel additive not only cleans the internal combustion engine of deposits but at the same time reduces the possibility of the fuel pre-igniting. The engine can thereby advantageously be protected from damage, and thus the maximum service life of the engine can be increased and the performance thereof can be maintained in the long term.

The internal combustion engine includes in particular motor vehicle and aircraft engines, preferably motor vehicle engines, but is not limited thereto. Alternatively, the internal combustion engine can also be an internal combustion engine used conventionally in industrial and agricultural machines, systems and devices, such as a lawnmower motor. In a preferred embodiment, the internal combustion engine is a motor vehicle engine, in particular a petrol engine.

The fuel is in particular a fuel used conventionally in the aforementioned internal combustion engines, preferably a petrol fuel such as commercially available regular or super petrol. The diarylamine can either be added directly to the fuel or be contained in a fuel additive, in particular in combination with other additives.

The diarylamine for use according to the present invention includes in particular at least one diarylamine according to general formula (I)

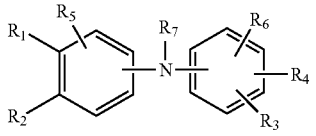

where $R_1$ to $R_7$ independently of one another are selected from hydrogen, $C_{1-14}$ alkyl, $C_{2-14}$ alkenyl or $C_{5-12}$ aryl. Such diarylamines are described, for example, in WO 2015/042337, to the entirety of which reference is hereby made.

The term "alkyl" includes in this case non-aromatic hydrocarbons. An alkyl group can be either straight-chain or branched or cyclic ("cycloalkyl"). The alkyl group includes in particular groups of $C_{1-10}$ alkyl, preferably $C_{1-6}$ alkyl, particularly preferably $C_{1-4}$ alkyl. The alkyl group can in particular be selected from methyl, ethyl, propyl, isopropyl, n-butyl, isobutyl, sec-butyl, and t-butyl, pentyl, 2-methylbutyl, 3-methylbutyl, 3,3-dimethylpropyl, hexyl, 2-methylpentyl, 3,3-dimethylbutyl, and 2,3-dimethylbutyl. Alkyl groups can also be substituted or non-substituted. The alkyl groups can also contain one or more heteroatoms ("heteroalkyl"). In a heteroalkyl group, one or more C atoms are replaced by a heteroatom, for example by nitrogen, oxygen, sulphur and phosphorus.

The term "alkenyl" relates to an unsaturated alkyl group which contains at least one C—C double bond which is not part of an aromatic group. An alkenyl group can also be straight-chain, branched or cyclic ("cycloalkenyl"). The alkyl group includes in particular $C_{2-10}$ alkenyl, preferably $C_{2-6}$ alkenyl, particularly preferably $C_{2-4}$ alkenyl. The alkenyl group can in particular be selected from $—C(CH_3)=CH_2$, $—CH=CH_2$, $—CH=C(CH_2CH_3)_2$, $—CH=CHCH_3$, $—C(CH_3)=CHCH_3$. Alkenyl groups can also be substituted or non-substituted. The alkenyl groups can also contain one or more heteroatoms.

A "cycloalk(en)yl group" relates to a monocyclic or polycyclic alk(en)yl group which is not aromatic and comprises at least three carbon atoms. Typical cycloalk(en)yl groups comprise in particular cyclopropyl, cyclobutyl, cyclopent(en)yl and cyclohex(en)yl, cyclohept(en)yl and cyclooct(en)yl. Cycloalk(en)yl groups can be substituted or non-substituted.

The term "aryl" relates to a group with an aromatic structure and includes in particular planar rings with a delocalised [pi] electron system, containing 4n+2 [pi] electrons, where n is a whole number. The aryl group can contain 5, 6, 7, 8, 9 or more than nine C atoms, which can also be substituted and/or contain heteroatoms ("heteroaryl"). Aryl groups and heteroaryl groups can be monocyclic or heterocyclic. Examples of aryl groups include phenyl, biphenyl, naphthyl, binaphthyl, pyrenyl, phenanthryl, anthracenyl, fluorenyl and indenyl. Examples of heteroaryl groups include pyrrolyl, imidazolyl, furyl, thienyl, oxazolyl, thiazolyl, tetrazolyl, pyridyl, triazolyl, indolyl, isoindolyl, benzofuranyl, dipenzofuranyl, benzothienyl and benzimidazolyl.

In a preferred embodiment, two groups from RI. to $R_6$ on the adjacent C atom together form a 5-, 6- or 7-membered ring. For example, $R_1$ and $R_2$, $R_1$ and $R_5$, $R_2$ and $R_5$ and/or two of $R_4$, $R_5$ and $R_6$ form a 5-, 6- or 7-membered ring.

It is also preferred for $R_1$ and $R_2$ together to form a 5- or 6-membered ring, $R_3$ to $R_6$ independently of one another to be selected from hydrogen and $C_{1-6}$ alkyl, and $R_7$ to be hydrogen.

Particularly preferably, the at least one diarylamine is a diphenylamine. Preferably, mono- and dialkylated diphenylamines such as 4-tert-butyldiphenylamine, 4,4'-di-tert-butyldiphenylamine, 4-tert-octyldiphenylamine, 4,4'-di-tert-octyldiphenylamine, 4,4'-di-octyldiphenylamine or 4,4'-di-(1-phenylethyl)diphenylamine and mixtures thereof are used. Other usual diphenylamines include one or more of octyl-, dioctyl-, nonyl-, dinonyl-, decyl and didecyldiphenylamine. A further preferred diphenylamine is styrenated diphenylamine.

The concentration of the at least one diarylamine in the fuel is usually 0.001 to 5 wt %, preferably 0.005 to 2 wt %, particularly preferably 0.01 to 0.2 wt %, in relation to the total weight of the fuel.

In a preferred embodiment, the fuel or the fuel additive also comprises one or more polyetheramines. Polyetheramines usually used in petrol engines are for example the polyetheramines disclosed in DE 37 32 908 A1, to the entirety of which reference is hereby made.

A preferred polyetheramine can be represented by the formula $R(OCH_2CH(R^1))_nA$, where R is selected from $C_{1-14}$ alkyl, $R^1$ is selected from hydrogen and $C_{1-14}$ alkyl, and n can be a number from 2-40. Preferred alkyl groups are as defined above for diarylamine. A is in particular selected from a group consisting of $—OCH_2CH_2NR^2R^2$, $OCH_2CH_2NR^3(CH_2)_mOR^4$, or $—NR^5R^5$, where $R^2$, $R^3$, $R^4$ and $R^5$ can independently be hydrogen, $C_{1-14}$ alkyl or $C_{1-14}$ alkenyl, and m can be a number between 2 and 12. A preferred polyetheramine is poly-1,2-butylene oxide-3-aminopropyl-$C_{11-14}$-isoalkyl ether. The polyetheramine usually has a molecular weight average ($M_w$) of 500-3000 as determined by gel permeation chromatography (GPC).

The fuel contains the polyetheramine or the mixture of polyetheramines usually in an amount of 10 to 700 ppm, preferably 20 to 400 ppm, particularly 50 to 200 ppm. The weight ratio of diarylamine to polyetheramine in the fuel or in the fuel additive is usually 1:1 to 30:1, preferably 3:1 to 16:1. In these amount ranges and ratios, the use of polyetheramine can further increase the cleaning performance of the diarylamine while at the same time reducing the possibility of pre-ignition, while higher amounts of polyetheramine can worsen the cleaning performance and the possibility of pre-ignition compared with fuel without additives.

In addition to the diarylamine to be used according to the invention and optional polyetheramine, the fuel or fuel additive can also contain further common additives such as corrosion inhibitors, stabilisers, antioxidants or detergents. Further optional additives include friction modifiers, lubricity improvers, octane boosters for petrol fuels and cetane boosters for diesel fuels, and dyes.

Corrosion inhibitors are usually ammonium salts of organic carboxylic acids, carboxylic acids or carboxylic acid anhydrides which tend to form films owing to the corresponding structure of the starting compounds. Corrosion inhibitors also often contain amines for reducing the pH. Heterocyclic aromatics are usually used for corrosion protection of non-ferrous metals.

Antioxidants or stabilisers can in particular be amines such as para-phenylenediamine, dicyclohexylamine, morpholine or derivatives of these amines. Typical phenolic antioxidants are sterically hindered phenols such as 2,6-di-tert-butyl-4-methylphenol or C7-C9-branched alkyl-[3-(3,5-di-tert-butyl-4-hydroxyphenyl)propionate.

The fuels can also contain amides and imides of polyisobutylene succinic acid anhydride, polybutene amine, polybutene polyamine and long-chain carbonamides and carbonimides as carburettor-, injector- and valve detergents (what are known as "deposit control additives").

Friction modifiers include in particular glycerol monooleates. Lubricity improvers are preferably fatty acids, fatty acid esters and fatty acid amides. Common octane boosters include in particular organic compounds such as methyl tert-butyl ether (MTBE), ethyl tert-butyl ether (ETBE), N-methylaniline and metalorganic compounds such as ferrocene or methylcyclopentadienyl manganese tricarbonyl (MMT). A typical cetane booster is 2-ethylhexyl nitrate, for example.

As carrier oils for concentrates of the additives to be used according to the invention, mineral oils, but also bright stock and synthetic oils such as polyalphaolefin, trimellitic acid ester or polyether can be used.

The time at which the fuel additive is added to the fuel is not subject to any limitations. Usually, the fuel additive can be used in a suitable dose both as what is known as a "refinery package", in which the fuel additive has been added to the fuel before being commercially marketed, and as what is known as an "aftermarket package", in which the fuel additive is usually not added to the fuel until shortly before combustion thereof, for example shortly before or after filling a motor vehicle.

In a further aspect, the present invention relates to a method for cleaning the combustion chamber of an internal combustion engine during the operation of the internal combustion engine by burning a fuel, wherein the fuel contains a fuel additive comprising at least one diarylamine, which can be alkylated. With respect to the preferred embodiments of the method according to the invention, reference is made to the embodiments described previously for the use according to the invention of the at least one diarylamine.

EXAMPLES

The present invention is explained in more detail by the following examples.

The following fuel additives were used:

Diarylamine: Mixture of a reaction product of diphenylamine and 2,4,4-trimethylpentene. Polyetheramine: Poly-1,2-butylene oxide-3-aminopropyl-C11-14-isoalkyl ether (Mw: 2500).

The final concentration of diphenylamine derivative in the fuel was 0.14 wt %.

The influence of the tendency to pre-ignite and the cleaning performance when a fuel was used were determined according to the following examples (additive variants). A fuel without additives was used as a comparative example.

Example 1: Additive Variant 1) 1400 ppm Diphenylamine Derivative+100 ppm Polyetheramine Example 2: Additive Variant 2) 1400 ppm Diphenylamine Derivative Example 3: Additive Variant 3) 1400 ppm Diphenylamine Derivative+500 ppm Polyetheramine Comparative Example 1: Fuel Without Additive

Engine Test Run

The engine test run was carried out on a 2 l turbocharged direct-injection engine with indicator head.

A low-quality fuel specified by Daimler AG was used as the test fuel. In the first step, a cleaning cycle was carried out with E5 RON95 fuel. This cleaning cycle is intended to clean out the combustion chamber completely and to produce a "zero state".

Then, pre-ignition endurance runs (PIER clean) are carried out, with test fuel without additives and with test fuel to which the additive to be tested has been added, and the number of pre-ignition events is recorded by means of pressure sensors for each cylinder. The pre-ignition endurance run consisted of multiple successive similar cycles. One cycle lasted 20 minutes, of which 15 minutes were at full load operation under conditions typical for pre-ignition, i.e. engine speed <2000 rpm and throttle completely open, and 5 minutes were at partial load with the same engine speed and the throttle virtually closed. In each case, 3 runs were carried out over an hour. This test run was intended to show the influence of the additive on the number of pre-ignition events in a clean combustion chamber in comparison with the fuel without additives.

In the third step, a cleaning run with E5 RON95 fuel was carried out again in order to restore the zero state. This "zero state" was documented endoscopically and then compared with the other tests.

Then, a 36 h carbonisation endurance run (CER) was carried out. With this endurance run, a typical city cycle is simulated, in which the coolant temperature is limited to 70° C., in order to build up carbonisation in the combustion chamber in a reproducible manner. This carbonisation endurance run was carried out using test fuel with additives and using fuel without additives as reference. The extent of the dirt was visually assessed by endoscope and compared with images before the carbonisation endurance run. The combustion chamber, the piston surface and the injection nozzle tip were examined.

Then, another pre-ignition endurance run (PIER carbonised) was carried out to determine the number of pre-ignition events with the carbonised combustion chamber.

An oil change was carried out before each pre-ignition endurance run to exclude any influence of the engine oil.

The engine test run to determine the cleaning performance of a fuel additive according to the present invention as described above is shown schematically in FIG. 1.

Determining Tendency to Pre-ignite With a Clean Combustion Chamber

Figure 2:
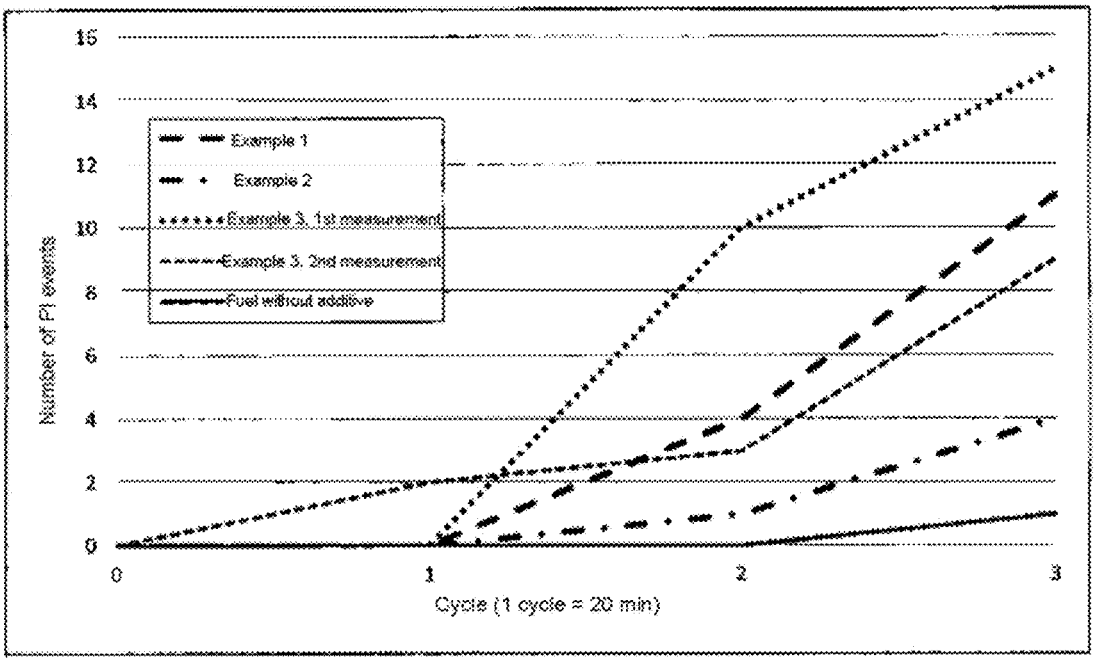
FIG. 2: Tendency of an engine to pre-ignite with and without use of the fuel additive according to the invention in a clean combustion chamber.

The number of pre-ignition events with a clean combustion chamber is shown in FIG. 2. It was found that the number of pre-ignition events was zero with a clean combustion chamber in the first cycle with additive of Examples 1 and 2 and with fuel without additives, and only rose during the second cycle with all additives. With the additive of Example 3, two pre-ignition events were counted during the second measurement in the first cycle. After three cycles, one pre-ignition event was counted with fuel without additives (comparative example), eleven with the additive of Example 1, four with the additive of Example 2, and up to fifteen events with the additive of Example 3. The higher the proportion of polyetheramine was, the more pre-ignition events were recorded, in particular in the first cycle. However, a rise in the events took place in the clean combustion chamber with all the additives, in comparison with fuel without additives. That is, polyetheramine has a higher tendency to pre-ignite than diphenylamine.

Determining Combustion Chamber Cleanliness

The endoscopic images of the combustion chamber before and after the carbonisation endurance run (CER 36 h) showed that fewer deposits were formed in the combustion chamber with the use according to the invention of additives containing diphenylamine than without additives. The additives of Examples 1 and 2 appeared comparable; in Example 3, with the highest proportion of polyetheramine, more deposits were observed.

A comparison of the injector tips showed that in particular the additive of Example 1 achieved a reduction in the deposits on the injectors.

Determining Tendency to Pre-ignite After Carbonisation

Figure 3:
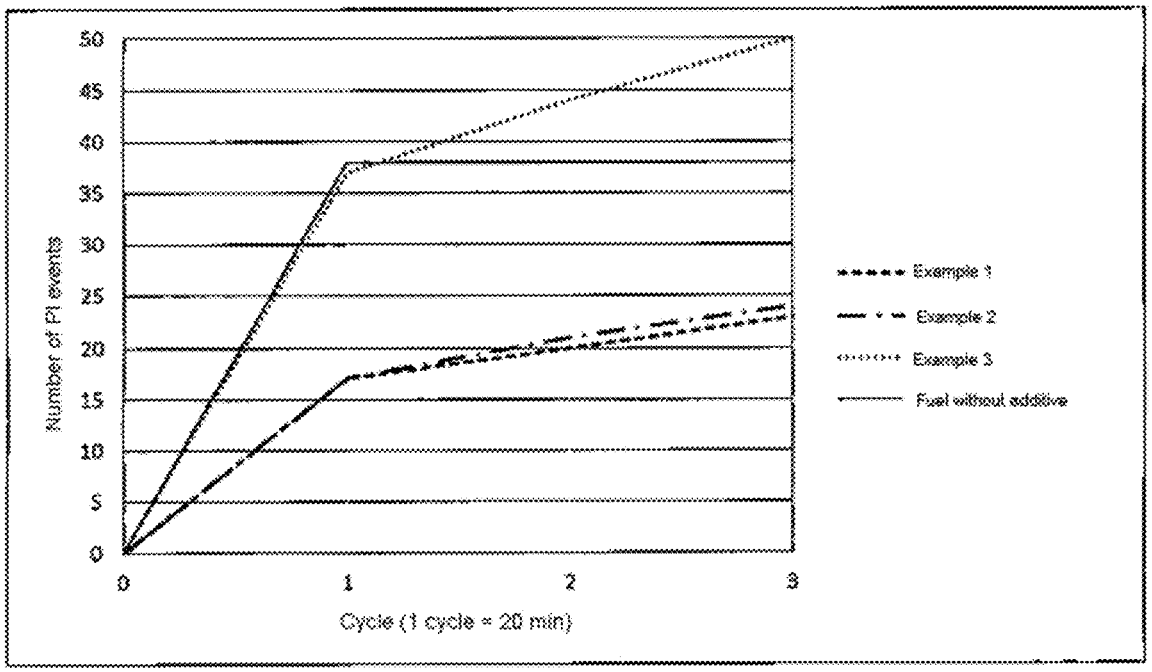
FIG. 3: Tendency of an engine to pre-ignite with and without use of the fuel additive according to the invention after carbonisation run.

In the second pre-ignition endurance run (PIER carbonised after 36 h CER), a considerable reduction in the pre-ignition events was observed with additive of Examples 1 and 2 (FIG. 3). The number of pre-ignition events was reproducibly halved in comparison with test fuel without additives. This halving confirms the cleaning effect of the two additives. A keep clean effect was found here. The additive of Example 3 produced an increase in the pre-ignition events, since the cleaning effect is also smaller, and therefore the negative effect on the pre-ignition can no longer be compensated by the cleaning.

In summary, it was surprisingly found in the present invention that, by cleaning or reducing the deposits in the combustion chamber of a motor vehicle engine, the tendency to pre-ignite is also reduced. The use according to the invention of diphenylamine derivatives results in a high cleaning performance in relation to combustion chamber deposits without affecting the engine performance. The general negative effect of the additives on the pre-ignition is compensated by the cleaning, and vice versa. When used in a certain mass ratio to diphenylamine or diphenylamine derivative, polyetheramines can further increase the cleaning performance thereof with respect to injector deposits. In particular, it was possible to demonstrate that the additive of Example 1, with a low polyetheramine content of 100 ppm, achieves a better cleaning performance with respect to injectors than pure diphenylamine (Example 2). However, with a high proportion of polyetheramine, both the deposits on injectors and the deposits in the combustion chamber increase, as shown by the results with the additive of Example 3. In this case, the cleaning is not sufficient to compensate for the negative effect on the pre-ignition.

Although it was possible to show with the above-described examples that the use according to the invention of diphenylamine derivatives results in a high cleaning performance, the combined use of diphenylamine derivatives and polyetheramine as described above is preferred, since this allows a combination of good cleaning effect in the combustion chamber and on the injectors with simultaneous reduction in pre-ignition.

Example 4

For Example 4, the following fuel additive (additive variant 4) was used:

Diarylamine: Styrenated diphenylamine

Polyetheramine: Poly-1,2-butylene oxide-3-aminopropyl-C11-14-isoalkyl ether (Mw: 2500).

The final concentration of diphenylamine derivative in the fuel was 1600 ppm, of polyetheramine 100 ppm.

The cleaning performance of additive variant 4 was tested in the vehicle after driving with fuel containing additives.

Test Execution

Figure 4A:
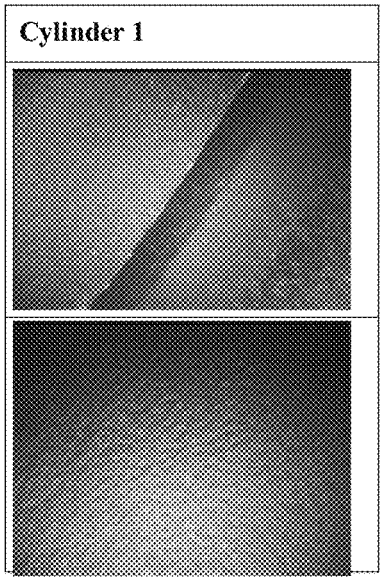
FIG. 4: Images of a combustion chamber of an engine before and after use of the fuel additive according to the invention.

The practical cleaning test was carried out with a Volkswagen VW Polo 4 cylinder TSI 1.2 litre direct-injection engine. The initial odometer reading was 40,986 km. The vehicle was operated with commercially available E5 RON95 fuel to which additive variant 4 was added in the appropriate concentration. The combustion chamber of the vehicle was endoscopically assessed and documented before the start of the test (FIG. 4*a*: Combustion chamber images before practical test, of one cylinder by way of example). After a run of 764 km with a mixed driving profile (city, cross-country, motorway) with fuel containing additives, the combustion chamber was again examined endoscopically.

Determining Combustion Chamber Cleaning

Figure 4B:
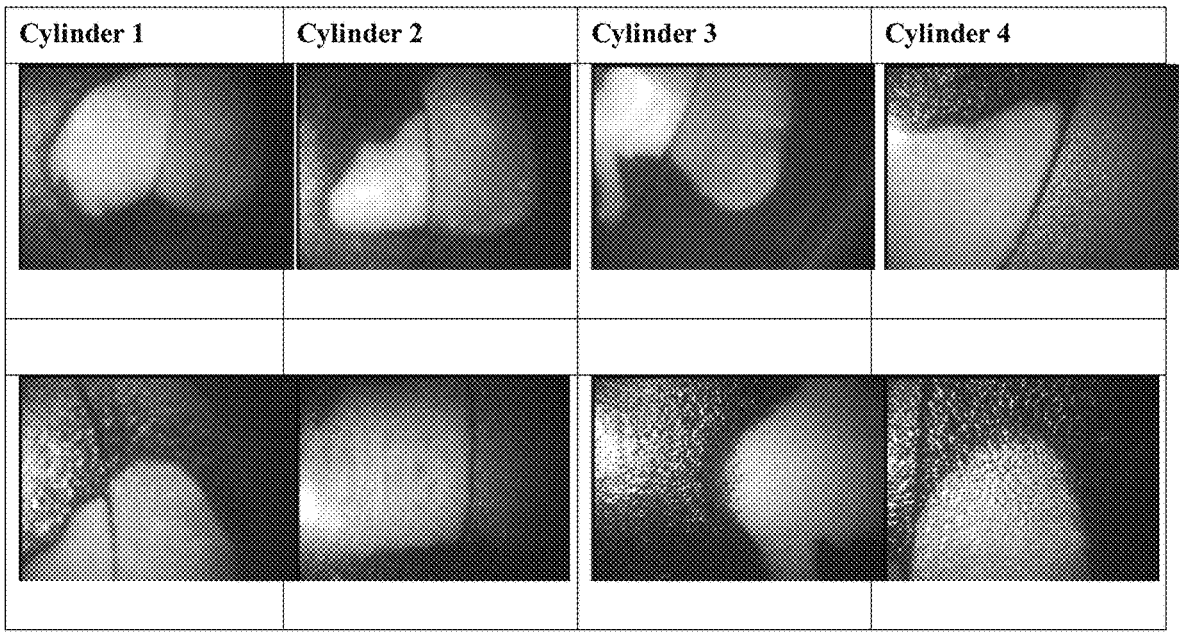

The endoscopic images show that a reduction in the amount of deposits can be established at the piston head in all the cylinders. Furthermore, after use of the fuel containing additives, complete removal of the deposits was surprisingly observed within a certain region of the piston head for all cylinders (FIG. 4*b*: Combustion chamber images after additive use in practical test). It is assumed that this is the region in which the surface is wetted by the injection jet.

It should be noted that the term "comprising" does not exclude other elements or steps and the "a" or "an" does not exclude a plurality. Also elements described in association with different embodiments may be combined.

The invention claimed is:

1. A method for cleaning the combustion chamber of an internal combustion engine during operation of the engine, comprising:

providing a fuel; and burning the fuel, wherein the fuel contains a fuel additive comprising at least one diarylamine, which can be alkylated, wherein the at least one diarylamine is selected from diarylamines of general formula (I):

(I)

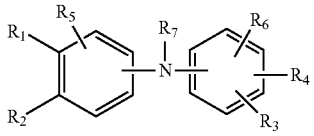

where $R_1$ to $R_7$ independently of one another are selected from hydrogen, $C_{1-14}$ alkyl, $C_{2-14}$ alkenyl or $C_{5-12}$ aryl, wherein two groups from $R_1$ to $R_6$ on an adjacent C atom together form a 5-, 6- or 7-membered ring.

2. The method of claim 1, wherein the internal combustion engine is a motor vehicle engine.

3. The method of claim 1, wherein providing the fuel simultaneously reduces the possibility of the fuel pre-igniting.

4. The method of claim 1, wherein $R_1$ and $R_2$ together form a 5- or 6-membered ring, $R_3$ to $R_6$ independently of one another are selected from hydrogen and $C_{1-6}$ alkyl, and $R_7$ is hydrogen.

5. The method of claim 1, wherein the at least one diarylamine is selected from diphenylamines, including one or more of octyl, dioctyl-, nonyl-, dinonyl-, decyl and didecyldiphenylamine.

6. The method of claim 1, wherein a concentration of the at least one diarylamine is 0.001 to 5 wt% in relation to the total weight of the fuel.

7. The method of claim 1, wherein the fuel is a petrol fuel.

8. The method of claim 1, wherein a surface of a piston and/or a fuel injector is cleaned.

9. The method of clam 1, wherein the fuel additive further comprises one or more polyetheramines.

10. The method of claim 9, wherein the weight ratio of diarylamine to polyetheramine in the fuel additive is 3:1 to 16:1.

11. The method of claim 1, wherein a concentration of the at least one diarylamine is 0.05 to 1 wt% in relation to the total weight of the fuel.

12. A petroleum-based fuel, comprising:

organic compounds obtained by distillation; and at least one diarylamine, which can be alkylated, wherein the at least one diarylamine is selected from diarylamines of general formula (I)

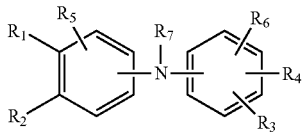

where $R_1$ to $R_7$ independently of one another are selected from hydrogen, $C_{1-14}$ alkyl, $C_{2-14}$ alkenyl or $C_{5-12}$ aryl, wherein two groups from $R_1$ to $R_6$ on an adjacent C atom together form a 5-, 6- or 7-membered ring.

* * * * *